US006792123B2

(12) United States Patent
Pavlovic

(10) Patent No.: US 6,792,123 B2
(45) Date of Patent: Sep. 14, 2004

(54) ELECTROACOUSTIC TRANSDUCER

(75) Inventor: Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 198 days.

(21) Appl. No.: 10/071,038

(22) Filed: Feb. 8, 2002

(65) Prior Publication Data

US 2002/0110254 A1 Aug. 15, 2002

(30) Foreign Application Priority Data

Feb. 14, 2001 (AT) ..... 227/2001

(51) Int. Cl.[7] ..... H04R 25/00

(52) U.S. Cl. ..... 381/174; 381/190; 381/191; 381/179; 367/170; 367/181

(58) Field of Search ..... 381/174, 191, 381/179, 113, 116, 190; 367/140, 170, 181; 29/25.41; 307/400

(56) References Cited

U.S. PATENT DOCUMENTS 3,991,285 A * 11/1976 Van Den Worm et al. .. 381/173

* cited by examiner

*Primary Examiner*—Curtis Kuntz
*Assistant Examiner*—Tuân D Nguyêñ
(74) *Attorney, Agent, or Firm*—Friedrich Kueffner

(57) ABSTRACT

An electrostatically operating electroacoustic transducer, operating as a sound receiver and configured to be mounted in a microphone capsule, has an electrode and a diaphragm connected to one another at a spacing from one another by a spacer ring, wherein on the electrode at least one first electric resistor is arranged which is connected to a power supply during operation of the microphone. The resistor is heated to prevent condensation of water vapor, and this improves the resistance of the microphone against ambient humidity.

4 Claims, 1 Drawing Sheet

ELECTROACOUSTIC TRANSDUCER

BACKGROUND OF THE INVENTION

1. Field of the Invention

The invention relates to an electrostatically operating electroacoustic transducer functioning as a sound receiver and employed in a microphone capsule. Independent of the way they operate with regard to physical principles, such transducers have a diaphragm exposed to a sound field and directly excited by the sound field so as to perform vibrations.

2. Description of the Related Art

The subject matter of the invention is thus an electrostatic microphone. The electrodes of the electrostatic transducer are in the form of an elastic, taut diaphragm and a rigid electrode which is usually referred to simply as electrode. Both form a capacitor whose capacitance changes as a result of the pressure fluctuations of the sound field. Since an electric field is generated between the electrodes of the electrostatic transducer, it is possible to transform the capacitance changes of the transducer by means of an amplifier arranged downstream into electric voltage changes.

Electrostatic capsules can be divided into two groups based on the way the electric field between its electrodes is applied:

1. Electrostatic capsules in which the charges are applied by means of an externally supplied voltage—capacitor capsules;
2. Electrostatic capsules in which the charges are "frozen" on the electrode or diaphragm so that in this way an externally supplied voltage becomes obsolete electret capsules.

In addition to various advantages relative to other sound receiving types, the two aforementioned types of electrostatic sound receivers have a major disadvantage: they are sensitive to the humidity in the air. Since, considered electrically, the above described capacitor is a high-resistivity device, it is absolutely mandatory for a successful electroacoustic transformation that the first stage of the amplifier arranged downstream is also of high resistivity. It is apparent that increased humidity in the air in the case of high-resistivity electric devices presents a great risk with respect to their reliability. A 100% protection of the amplifier against negative effects of the humidity in the air can be obtained by a consequent application of the known lacquering measures. In this connection, sealing by means of different types of lacquer, varnish, or enamel successfully prevents that the humidity of the air can negatively affect the electric properties of the amplifier. However, in the case of a capsule, the protection against humidity is much more complicated. The only direct insulation path between the electrodes of the capacitor is the spacer ring. An increased humidity results in condensation which has a negative effect on the quality of the insulation path in the area of the spacer ring and is recognizable as an unpleasant crackling sound during operation of the microphone.

According to the present solutions of the prior art, this problem is solved in that the insulation path between electrode and diaphragm is to be made as large as possible. However, this leads to larger and more expensive capsules with still only a small or unsatisfactory improvement of the resistance to humidity.

SUMMARY OF THE INVENTION

It is an object of the present invention to provide a better protection than in the past against the risk of short-circuiting between the electrodes of a microphone of the aforementioned kind in the presence of high ambient humidity without this increasing significantly the size of the microphone capsule or its manufacturing costs.

In accordance with the present invention, this is achieved in that on the rigid electrode, preferably on the side facing away from the diaphragm, at least one electric resistor is arranged, preferably by gluing, which is connected to a power supply during operation of the microphone.

With this measure the rigid electrode and thus its edge area and therefore the sensitive area where the diaphragm is secured is heated by a few fractions of degrees to a temperature above the ambient temperature; this is already sufficient to prevent condensation reliably. Since on the backside of the electrode there is always a hollow space provided, which is mandatory for reasons of acoustic tuning, the dimensions of the capsule are not changed.

Supplying power does not present a problem and can be realized by separate lines through which hardly any power must be transmitted and which therefore can be configured to be thin. As is known in the art, microphones, which operate on the basis of electrostatic principles, require a power supply for supplying energy to the amplifier downstream of the capsule which, in turn, can be a separate battery supply or in the form of a so-called phantom power supply (audio mixer). This phantom power supply can also be used for operating the resistor.

DESCRIPTION OF THE PREFERRED EMBODIMENTS

Figure 1:
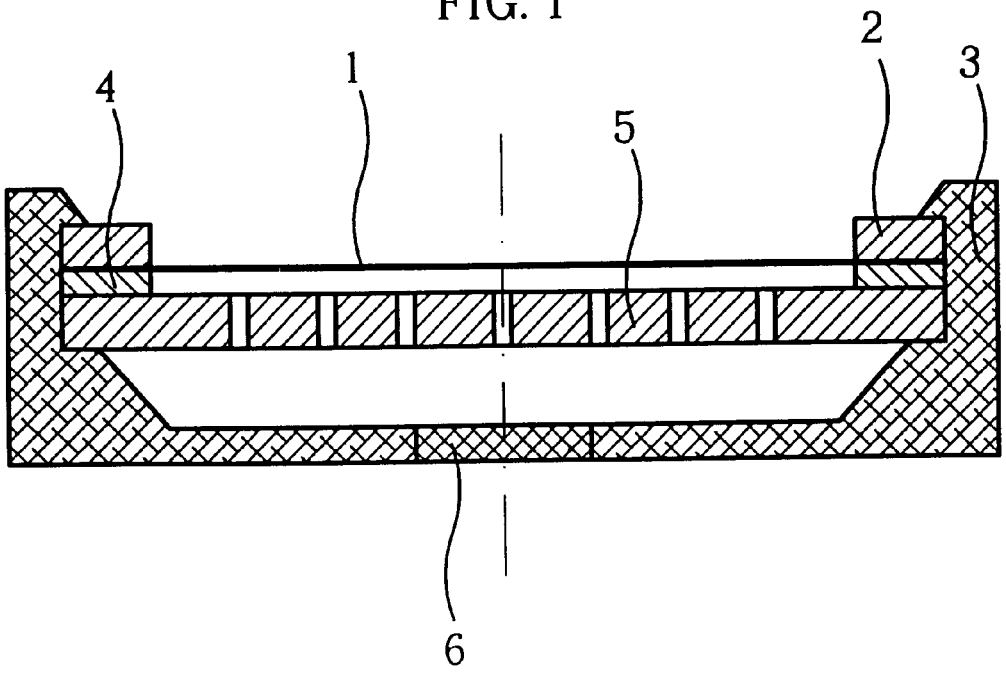
FIG. 1 shows an electrostatic microphone in section.

FIG. 1 shows a conventional electrostatic transducer in section. A diaphragm 1 is mounted by means of the diaphragm ring 2 in the capsule carrier 3. The spacer ring 4 secures the diaphragm 1 and the electrode 5 at a small spacing of approximately 40 $\mu$m or less from one another and is comprised of an electrically well insulating material, preferably of a foil. Behind the electrode, an acoustic friction 6, inserted into the capsule carrier 3 at a spacing from the electrode, is provided which is required for acoustic tuning of the capsule.

Figure 2:
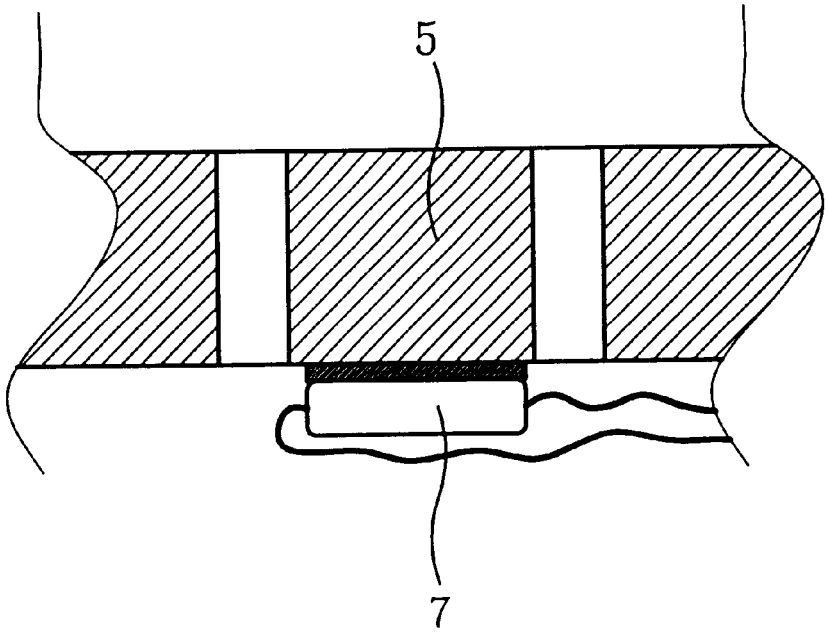
FIG. 2 shows an enlarged detail of the resistor mounted according to the invention on the electrode.

FIG. 2 illustrates the invention. A part of the electrode 5 is illustrated on a greatly enlarged scale. An electric resistor 7 is attached to the electrode and is connected to a power supply. The resistor 7 is provided in order to heat the electrode 5. In order to reach in a targeted fashion the condensation of water vapor or to prevent its condensation, it is required and sufficient in environments "contaminated" by water vapor to provide a small temperature differential of only a few tenths ° C. between two areas or components.

Since the microphone capsule is mounted in a microphone housing and since it is protected by a wire mesh cage against mechanical damage, it is easy to achieve such a temperature differential between the interior of the capsule and the microphone housing or the wire mesh cage. In this way, condensation within the capsule is prevented and the capsule is protected reliably against humidity in the air.

A preferred variant of the invention provides an electric control circuit which makes it possible to maintain or generate a predetermined temperature differential between the interior of the capsule and the microphone housing, even for greatly varying external temperatures. Such a control circuit can be easily realized by a person skilled in the art in view of the disclosure of the invention. For example, an electric resistor with known temperature sensitivity can be arranged external to the capsule. The size of this resistor and the size of the heating resistor on the electrode are compared with one another periodically or continuously during operation. As a function of the result of the comparison, the current intensity through the heating resistor is changed until the desired temperature differential is obtained. In this way, the capsule is protected against overheating, on the one hand, and the power consumption is minimized, on the other hand; moreover, the humidity protection is ensured over a wide range of ambient temperature.

The heating resistor 7 can be in the form of any ohmic resistance; preferably, in particular in the last mentioned variant of the invention, resistors with known temperature coefficients are employed. The employed adhesive can be any adhesive which is conventionally used in electrical engineering; knowing the composition of the employed electrode 5 and the resistor 7, a person skilled in the art can easily select a suitable adhesive.

While specific embodiments of the invention have been shown and described in detail to illustrate the inventive principles, it will be understood that the invention may be embodied otherwise without departing from such principles.

What is claimed is:

1. An electrostatically operating electroacoustic transducer, operating as a sound receiver and configured to be mounted in a microphone capsule, comprising:

an electrode, a diaphragm, and a spacer ring connecting the electrode and the diaphragm to one another at a spacing to one another; and at least one first electric resistor arranged on the electrode, wherein the at least one electric resistor is configured to be actively connected to a power supply during operation of the microphone so as to heat the electrode above ambient temperature to prevent condensation.

2. The electroacoustic transducer according to claim 1, wherein the at least one first electric resistor is arranged on a side of the electrode facing away from the diaphragm.

3. The electroacoustic transducer according to claim 1, wherein the at least one first electric resistor is glued to the electrode.

4. The electroacouStic transducer according to claim 1, mounted in a microphone capsule, further comprising:

a second electric resistor having a temperature sensitivity and arranged external to the microphone capsule; and a measuring and control circuit, wherein the at least one first electric resistor and the second electric resistors are connected to the measuring and control circuit and wherein the measuring and control circuit controls, based on measured resistance values, a supply of power to the at least one first electric resistor.

* * * * *